United States Patent [19]

Reed

[11] Patent Number: 4,514,249

[45] Date of Patent: Apr. 30, 1985

[54] DEVICE FOR MAKING GROOVES IN CIGARETTE FILTERS

[75] Inventor: Steven P. Reed, Felton, Calif.

[73] Assignee: Brown & Williamson Tobacco Corporation, Louisville, Ky.

[21] Appl. No.: 632,509

[22] Filed: Jul. 19, 1984

[51] Int. Cl.[3] ..... B28B 11/08

[52] U.S. Cl. ..... 156/553; 156/219; 264/293; 425/385; 425/392; 493/43

[58] Field of Search ..... 156/209, 219, 220, 441, 156/500, 553; 493/42, 43; 264/284, 293; 425/383, 385, 392; 101/4–6, 8, 11, 22–25, 36–37

[56] References Cited

U.S. PATENT DOCUMENTS

| | | | |
|---|---|---|---|
| 4,324,540 | 4/1982 | Sexstone et al. | 493/42 X |
| 4,436,517 | 3/1984 | Lebet | 493/43 X |
| 4,480,982 | 11/1984 | Sexstone et al. | 425/392 X |

*Primary Examiner*—David Simmons
*Attorney, Agent, or Firm*—Charles G. Lamb

[57] ABSTRACT

An apparatus for forming grooves in the peripheral surface of a filter rod includes two endless conveyor devices located such that one conveyor flight of a first one of the endless conveyor devices is generally parallel to and spaced from one conveyor flight of the second one of the endless conveyor devices. The first and second conveyor devices each have a plurality of filter rod receiving pockets at spaced apart intervals along their lengths. The pockets in the first and second conveyor devices cooperate across the space between their facing flights to hold cigarette filters to be grooved at predetermined spaced apart intervals as the endless conveyor devices move the filter rods through the apparatus. A grooving roller is located between the ends of each of first and second endless conveyor devices. The grooving rollers have radially extending groove forming projections which upon revolution of the rollers sequentially project into the space between the facing flights of the first and second endless conveyor devices. The groove forming projections embed in the filter rods carried by the conveyor devices between their facing flights thereby forming the grooves in the filter rods.

16 Claims, 4 Drawing Figures

DEVICE FOR MAKING GROOVES IN CIGARETTE FILTERS

BACKGROUND OF THE INVENTION

1. Field of the Invention

The present invention relates to the manufacture of filters for cigarettes and more particularly to the making of grooves in cigarette filters.

2. Description of the Prior Art

Cigarettes are often provided with filter devices at one end to remove materials from the smoke stream coming from the tobacco column during smoking. These filters, which are attached to the tobacco column, come in many different sizes, shapes and forms. Some filters which are presently on the market include grooves. In some filter constructions, the grooves facilitate the by-passing of smoke around the filter. In other filter constructions, the grooves provide a channel for mixing ventilating air and by-passed smoke. In stilll other constructions, the grooves provide a path for only ventilating air to pass therealong without mixing with smoke.

In the manufacture of grooved cigarette filters, many suggestions have been made for making the grooves in the filter rod. U.S. Pat. No. 3,804,695 shows the use of a pair of parallel rollers in pressure engagement defining a nip therebetween wherein one of the rollers is provided with a circumferential or a helical grooved surface so that, as a filter rod passes therethrough, permanent depressions are made along the longitudinal dimensions of the filter rod. U.S. Pat. No. 4,075,936 shows a die having cam manipulated radially reciprocating pins that periodically move into and out of the longitudinal path of a filter rod as the filter rod tow moves past. When the pins extend into the path of the tow they impress grooves in the filter rod. U.S. Pat. No. 4,149,546 shows an apparatus for making grooves in a cigarette filter wherein a filter rod is moved in an arcuate path transverse to a heated forming means, the filter rod being supported and conveyed for relative movement at the periphery of a drum-shaped inner rotor and the forming means compresses a heated arcuate outer strator element or elements projecting inwardly toward the rotor. U.S. Pat. No. 4,324,540 teaches an apparatus for making grooves in filters which comprises a plurality of fixed position groove forming blades and a filter plug conveying device located next to the groove forming blades. Cigarette filters to be grooved are moved along the path between the conveyor device and blades, rolling past the blades whereupon grooves are formed in the filters by the blades.

SUMMARY OF THE INVENTION

The present invention provides an apparatus for making grooves in cigarette filter rods. The present invention further provides a device for concurrently forming a plurality of elongated grooves in the peripheral surface of a filter rod.

More particularly, the present invention provides an apparatus for making grooves in the peripheral surface of a filter rod comprising first endless conveyor means; second endless conveyor means located next to the first endless conveyor means with one flight of the second endless conveyor means in facing spaced apart, generally parallel relationship to one flight of the first endless conveyor means; means associated with the first and second endless conveyor means for holding the filter rods at predetermined spaced apart intervals along the space between the facing flights of the first and second endless conveyor means; and, grooving means located between the ends of the endless conveyor means for forming grooves in the filter rods in the space between the facing flights of the first and second endless conveyor means as the filter rods move with the facing flights from one end of the endless conveyor means to the other end of the endless conveyor means.

BRIEF DESCRIPTION OF THE DRAWINGS

A more complete understanding of the present invention will be obtained upon reference to the following description in conjunction with the accompanying drawings in which like numerals refer to like parts and wherein.

DSCRIPTION OF THE PREFERRED EMBODIMENTS

Figure 1:
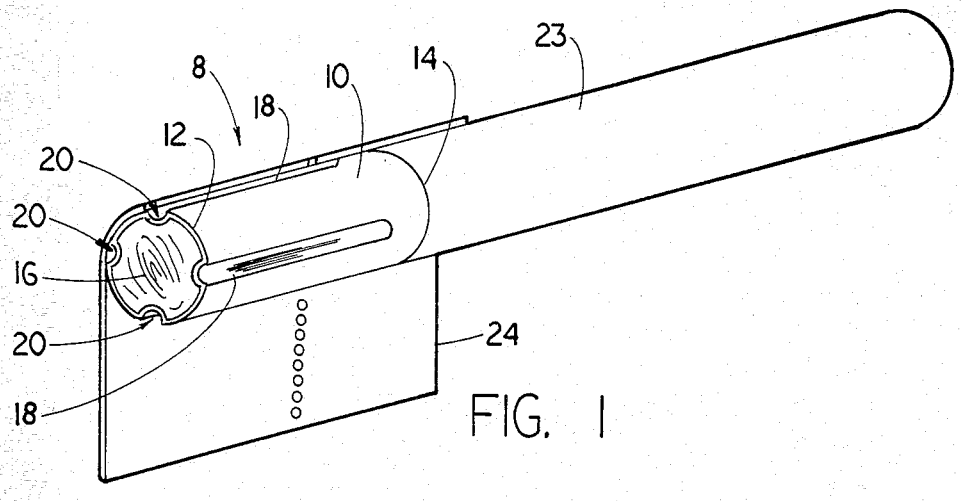
FIG. 1 is a perspective view of a representative filter rod capable of being manufactured by the apparatus of the present invention.

Novel cigarette filters 8 of the type illustrated in FIG. 1 comprise a generally cylindrically shaped fiter rod 10 fabricated of an air and smoke permeable material and a circumscribing wrapper 12 fabricated of an air and smoke impermeable material. The wrapper 12 extends longitudinally of the filter rod 10 frome end 14 of the filter rod to the other end 16 thereof so that the filter rod ends 14 and 16 are in mutual flowthrough relationship. The filter 8 includes a plurality of grooves 18 formed in the wrapper 12 and embedded into the filter rod 10. Each of the grooves 18 is open, as designated by the number 20, at the mouth end 16 of the filter rod 10 and extends therefrom in a generally longitudinal direction of the filter rod 10 for a distance less than the length of the filter rod 10. The grooves 18 are illustrated as being four in number, and equally spaced from each other about the circumference of the filter rod 10. The filter rod 10 is attached to a tobacco column 23 by means of an air permeable tipping material 24 which circumscribes the filter rod and overlaps a portion of the tobacco column in a manner known in the art to form a filtered cigarette. In FIG. 1, the tipping material is shown in a partially unwrapped position to more clearly show details of the wrapped filter rod.

Figure 2:
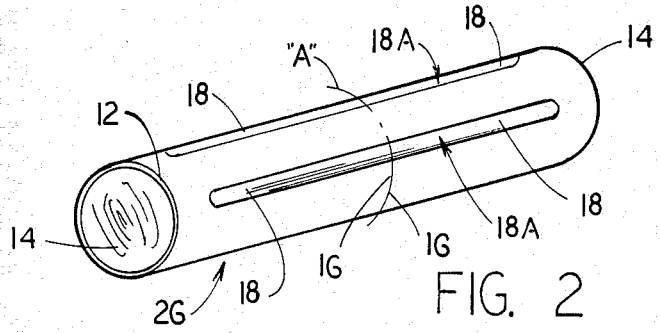
FIG. 2 is a perspective view of a filter tow from which the representative filter rod of FIG. 1 is made, and which is also which the apparatus of the present invention is capable of manufacturing.

Now with reference to FIG. 2, as a manufacturing expedient, individual filter rods 10 are manufactured from a filter tow 26. The filter tow 26 is of a generally cylindrical shape and is as long as a preselected number of filter rods 10. The filter tow 26 is formed with longitudinally extending grooves 18A, each of which is twice as long as a groove 18 in the filter rod 10. The double length grooves 18A are arranged in groups of circumferentially spaced apart grooves, the groups being spaced apart longitudinally of the filter rod tow 26. Each group of double length grooves 18A consists of from three to seven grooves circumferentially, equally spaced apart about the perimeter of the filter rod tow 26. The filter rod 26 is severed, generally transversely to the longitudinal centerline of the filter tow 26, at intervals corresponding to the desired filter rod 10 length, into individual filter rods 10. As illustrated, the filter tow 26 is severed at locations (denoted by the dashed line "A") at the transverse centerline of the double length grooves 18A. Thus in the illustration of FIG. 2, two individual filter rods 10 are produced by severing the filter tow 26 at the dashed line "A".

Figure 4:
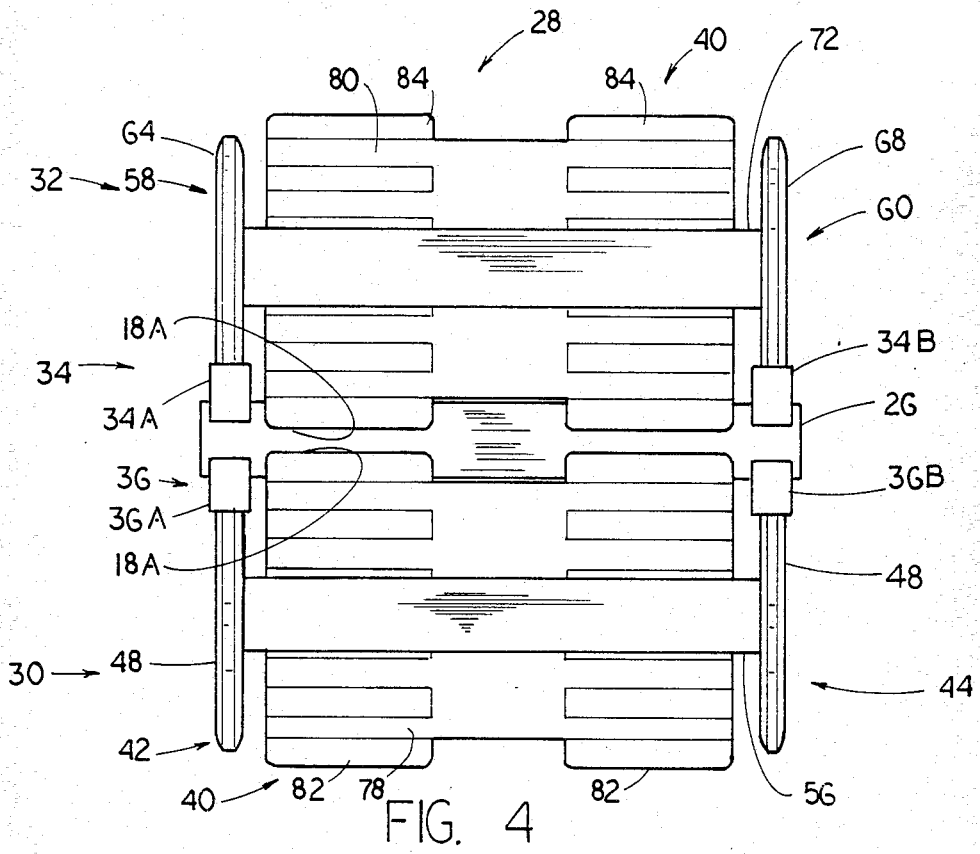
FIG. 4 is a cross-sectional view of the apparatus of FIG. 3 as viewed in the direction of arrows 4—4 in FIG. 3.
Figure 3:
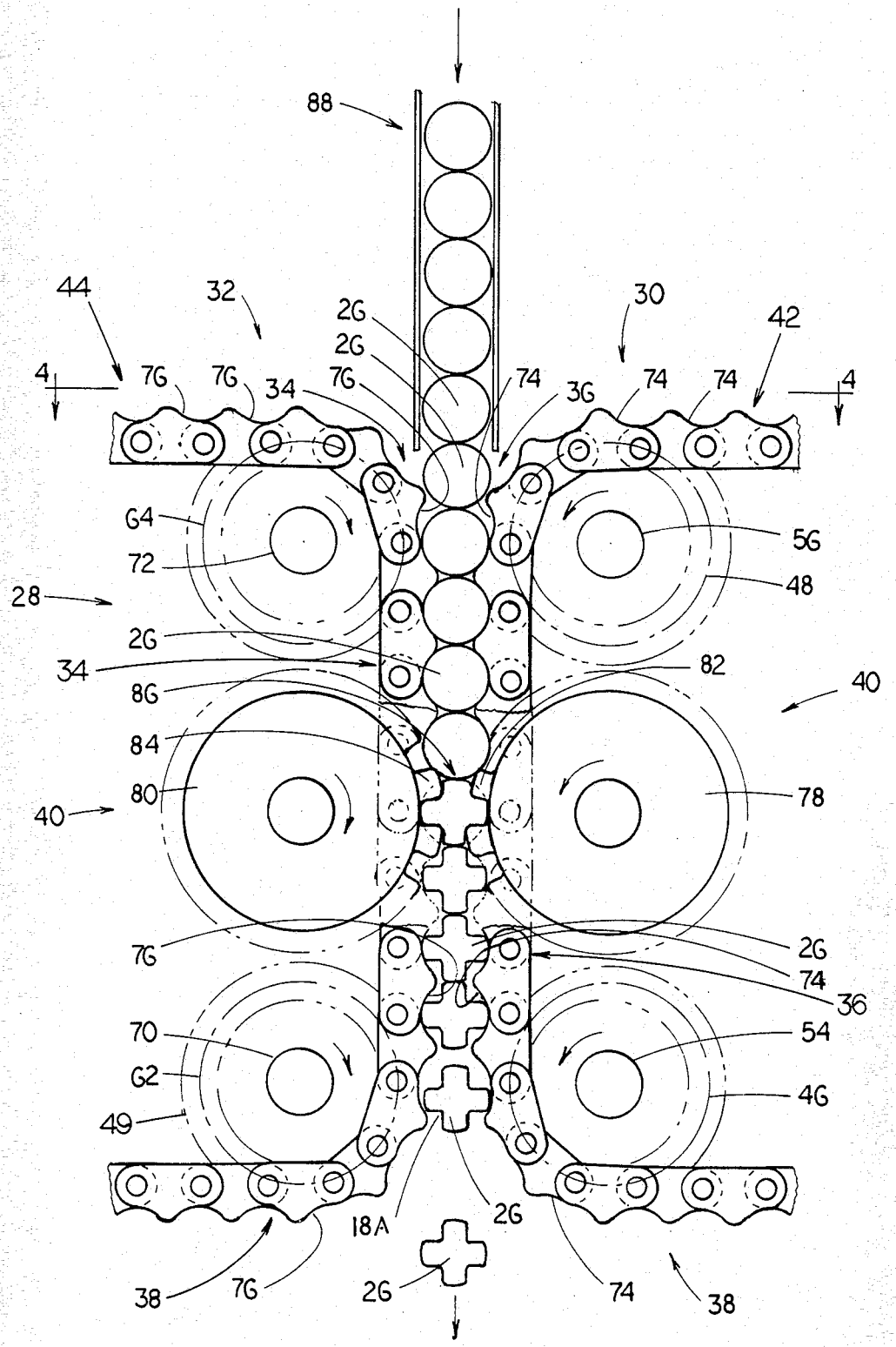
FIG. 3 is a side view of an apparatus embodying the present invention.

FIGS. 3 and 4 show a device, generally denoted as the numeral 28, for making grooves 18 in the filter rod 10 of FIG. 1. The following discussion will speak to forming double length grooves 18A in the filter tow 26, but it should be clearly understood that the apparatus 28 could just as readily be used to form grooves 18 in individual filter rods 10 essentially without modification.

Referring to FIGS. 3 and 4, the groove making apparatus 28 comprises first endless conveyor means, generally denoted as the numeral 30, and second endless conveyor means, generally denoted by the numeral 32. The second endless conveyor means 32 is located next to the first endless conveyor means 30 with one flight 34 of the second endless conveyor means 32 in facing, spaced apart, generally parallel relationship to one flight 36 of the first endless conveyor means 30. Filter tow holding means, generally denoted by the numeral 38, are associated with the first and second endless conveyor means 30 and 32 for holding the filter tow 26 at predetermined spaced apart intervals along the space between the facing flights 36 and 34 of the first and second endless conveyor means 30 and 32, respectively. Grooving means, generally denoted as the numeral 40, is located between the ends of the endless conveyor means 30 and 32 for forming grooves in the filter tow 26 in the space between the facing conveyor flights 34 and 36 as the filter tow 26 moves with the facing conveyor flights 34 and 36 from one end of the endless conveyor means 30 and 32 to the other end.

As shown in FIG. 3, the facing flights 34 and 36 of the second and first endless conveyor means 32 and 30 are substantially vertical and move in a downward direction. However, it should be clearly understood that the facing flights 34 and 36 can be oriented at any other angle to the horizontal, or be oriented in horizontally without departing from the scope and spirit of the invention.

With continued reference to FIG. 3 and additional reference to FIG. 4, the first endless conveyor means 30 comprises a pair of endless chain conveyors 42 and 44 located in spaced apart, side-by-side relationship. The endless chain conveyors 42 and 44 each has a head sprocket 46 and a tail sprocket 48. The head sprockets 46 are mounted to a common shaft 54, and the tail sprockets 48 are mounted to a common shaft 56. The second endless conveyor means 32 comprises a pair of endless conveyors 58 and 60 located in spaced apart, side-by-side relationship. The endless chain conveyors 58 and 60 each has a head sprocket 62 and a tail sprocket 64. The head sprockets 62 are mounted to a common shaft 70, and the tail sprockets 64 are mounted to a common shaft 72.

With continued reference to FIGS. 3 and 4, one flight of each of the endless chain conveyors 58 and 60 of the second endless conveyor means 32 is in facing, spaced apart, generally parallel relationship to a flight of a different one of the endless chain conveyors 42 and 44 of the first endless conveyor means 30. As illustrated, the flight 34A of endless chain conveyor 58 of the second endless conveyor means 32 is in facing, spaced apart, generally parallel relationship to the flight 36A of the endless chain conveyor 42 of the first endless conveyor means 30, and the flight 34B of the endless chain conveyor 60 of the second endless conveyor means 32 is in facing, spaced apart, generally parallel relationship to the flight 36B of endless chain conveyor 44 of the first endless conveyor means 30. The space between the flights 34A and 34B of the endless chain conveyors 58 and 60, respectively, is less than the length of the filter tow 26. The space between the flights 36A and 36B of the endless chain conveyors 42 and 44, respectively, is substantially the same as the space between the flights 34A and 34B of the endless chain conveyors 58 and 60.

As can be best seen in FIG. 3, the filter tow holding means 38 associated with the first endless conveyor means 30 includes a plurality of pockets 74 formed in the chains of each of the endless chain conveyors 42 and 44. The pockets 74 are at spaced intervals along the entire length or loop of the conveyor chains of the chain conveyors 42 and 44. The filter tow holding means 38 associated with the second endless conveyor means 32 includes a plurality of pockets 76 formed in the chains of eah of the endless chain conveyors 58 and 60. The number of pockets 76 in each endless chain conveyor 58 and 60 is preferrably equal to the number of pockets 74 in each endless chain conveyor 42 and 44. Each pocket 76 in each endless chain conveyor 58 and 60 of the second endless conveyor means 32 moving in the flight 34A and 34B, respectively, faces toward the first endless conveyor means 30 and is aligned with a different one of the pockets 74 of a different one of the chains conveyors 42 and 44 of the first conveyor means 30 moving in the flights 36A and 36B, respectively. For example, as illustrated, each of the pockets 76 moving in flight 34A of endless chain conveyor 58 is in alignment with a different one of the pockets 74 moving in the flight 36A of the endless chain conveyor 42 across the space separating the flights 34A and 36A. Further, each of the pockets 76 moving in the flight 34B of endless chain conveyor 60 is in alignment with a different one of the pockets 74 moving in the flight 36B of endless chain conveyor 44 across the space separating the flights 34B and 36B.

With reference to FIGS. 3 and 4, the grooving means 40 is illustrated as including a pair of grooving rollers 78 and 80. The first grooving roller 78 is located between the ends of the flights 36A and 36B of the conveyor chains of the first endless conveyor means 30, i.e. between the head sprockets 46, and tail sprockets 48. Further, the first grooving roller 78 is located in the space between flights 36A and 36B. The second grooving roller 80 is located between the ends of the flights 34A and 34B of the conveyor chains of the second endless conveyor means 32, i.e., between the head sprockets 62 and tail sprockets 64. Further, the second grooving roller 80 is located in the space between the flights 34A and 34B.

The first grooving roller 78 has a plurality of groove forming projections 82 spaced apart about the periphery of the first grooving roller and extending outwardly therefrom in a generally radial direction. Preferrably, the gap between adjacent groove forming projections 82 is less than the diameter of a filter tow 26. The second groove forming roller 80 also has a plurality of groove forming projections 84 spaced apart about the periphery of the second grooving roller and extending outwardly therefrom in a generally radial direction. Preferrably, the gap between adjacent groove forming projections 84 is less than the diameter of a filter tow 26. Further, the number of groove forming projections 84 of the second roller 80 preferrably are equal to the number of groove forming projections 82 of the first roller 78.

With reference particularly to FIG. 3, the first and second groove forming rollers 78 and 80 are illustrated as being in substantial alignment with each other across the space between the facing conveyor flights 36A and 34A and 36B and 34B of the first and second endless conveyor means 30 and 32, respectfully. The first and second groove forming rollers 78 and 80 cooperate to define a bite, generally denoted as the numeral 86. The bite 86 is substantially centered in the space between the facing conveyor flights.

The apparatus 28 also includes loading means 88 for depositing a filter tow 26 to be grooved between the pockets 74 of flight 36A and the pockets 76 of flight 34A, and the pockets 74 of flight 36B and pockets 76 of flight 34B as these pockets move into mutual alignment at the one end of the apparatus. As a pocket 74 of the first conveyor means 30 moves into alignment with a pocket 76 of the second conveyor means 32, they cooperate to hold a filter tow 26 in position between the facing flights 34 and 36, thereof, and move the filter tow 26 through the apparatus 28. The flights 34 and 36 move the filter tow 26, one at a time, though the bite 86 between the grooving rollers 78 and 80. As the filter tow 26 move through the bite 86, two adjacent groove forming projections 82 of groove forming roller 78 embed into the periphery of the filter tow 26 and two adjacent groove forming projections 84 of the groove forming roller 80 embed into the periphery of the filter tow 26. Thus, as shown, four grooves 18A are concurrently formed in each filter tow 26.

After the groove filter tow 26 exits the apparatus 28, it is conveyed to another work station (not shown) where it is severed into individual filter rods 10 as discussed above.

It should be understood that the apparatus can be used to form grooves 18 in filter rods 10 essentially without modification and, therefore, the term filter rod is used in a generic sense in the appended claims to mean either individual filter rods 10 or filter tow 26 from which individual filter rods 10 are cut after the apparatus 28 of the present invention has formed the grooves therein.

The foregoing detailed description is given primarily for clearness of understanding and no unnecessary limitations should be understood therefrom for modifications will become obvious to those skilled in the art upon reading this disclosure and may be made without departing from the spirit of the invention or scope of the appended claims.

What is claimed is:

1. An apparatus for forming grooves in a cigarette filter rod comprising:

first endless conveyor means;

second endless conveyor means located next to the first endless conveyor means with one flight of the second endless conveyor means in facing, spaced apart, generally parallel relationship to one flight of the first endless conveyor means;

means associated with the first and second endless conveyor means for holding the filter rods at predetermined spaced apart intervals along the space between the facing flights of the first and second endless conveyor means; and, grooving means located between the ends of the endless conveyor means for forming grooves in the filter rods in the space between the facing flights of the first and second endless conveyor means as the filter rods move with the facing flights from one end of the endless conveyor means to the other end of the endless conveyor means.

2. The apparatus of claim 1 wherein the facing flights of the first and second endless conveyor means are at an angle to the horizontal.

3. The apparatus of claim 2, wherein the facing flights of the first and second endless conveyor means are generally vertical.

4. The apparatus of claim 1, wherein the facing flights of the first and second endless conveyor means are generally horizontal.

5. The apparatus of claim 1, wherein the grooving means comprises:

a first grooving roller located between the ends of the first endless conveyor means, the first grooving roller having at least one groove forming projection extending generally radially outwardly, and upon revolution of the roller the at least one groove forming projection moves into and out of the space between the facing conveyor flights; and, a second grooving roller located between the ends of the second endless conveyor means, the second grooving roller having at least one groove forming projection extending generally radially outwardly, and upon revolution of the roller the at least one groove forming projection moves into and out of the space between the facing conveyor flights.

6. The apparatus of claim 5, wherein the first and second grooving rollers are in substantial alignment with each other across the space between the facing conveyor flights such that the filter rods to be grooved moving with the conveyor flights pass through the bite between the first and second grooving rollers whereupon the at least one groove forming projection of each grooving roller embeds into the filter rod.

7. The apparatus of claim 5 wherein:

the first grooving roller comprises a plurality of groove forming projections spaced apart about the periphery of the first grooving roller; and, the second grooving roller comprises a plurality of groove forming projections spaced apart about the periphery of the second grooving roller.

8. The apparatus of claim 7, wherein:

the groove forming projections of the first grooving roller are spaced apart by a distance less than the diameter of a filter rod; and, the groove forming projections of the second grooving roller are spaced apart by a distance less than the diameter of a filter rod.

9. The apparatus of claim 8, wherein the first and second grooving rollers are in substantial alignment with each other across the space between the facing conveyor flights such that the filter rods to be grooved moving with the conveyor facing flights pass through the bite between the first and second grooving rollers whereupon two adjacent groove forming projections of each grooving roller embed into the filter rod.

10. The apparatus of claim 1, wherein the means for holding the filter rods at spaced apart intervals comprises:

means defining a plurality of pockets in the first endless conveyor means spaced apart at predetermined intervals therealong;

means defining a plurality of pockets in the second endless conveyor means spaced apart at predetermined intervals therealong; and, each pocket of the first endless conveyor means moving in the facing flight of the first endless conveyor means is in alignment with a different one of the pockets of the second endless conveyor means moving in the facing flight of the second endless conveyor means across the space between the facing conveyor flights.

11. The apparatus of claim 10 further comprising means for depositing a filter rod to be grooved between a pocket of the first conveyor means and a pocket of the second endless conveyor means moving into mutual alignment at one end of the apparatus.

12. The apparatus of claim 1, wherein:

the first endless conveyor means comprises a pair of endless chain conveyors located in spaced apart, side-by-side relationship;

the second endless conveyor means comprises a pair of endless chain conveyors located in spaced apart, side-by-side relationship;

one flight of each of the endless chain conveyors of the second endless conveyor means being in facing, spaced apart, generally parallel relationship to a flight of a different one of the endless chain conveyors of the first endless conveyor means;

the space between the facing flights of the pair of endless chain conveyors of the first endless conveyor means being less than the length of the filter rods; and, the space between the facing flights of the pair of endless chain conveyors of the second endless conveyor means being less than the length of the filter rods.

13. The apparatus of claim 12, wherein:

the filter rod holding means associated with the first endless conveyor means comprises a plurality of pockets formed in the chain of each of the endless chain conveyors, at spaced intervals along the entire length of the chain, each pocket in one chain being in alignment with a different one of the pockets of the other chain;

the filter rod holding means associated with the second endless conveyor means comprises a plurality of pockets formed in the chain of each of the endless chain conveyors at spaced intervals along the entire length of the chain, each pocket in one chain being in alignment with a different one of the pockets of the other chain; and, each pocket in each chain of the first conveyor means moving in the flight thereof facing toward the second conveyor means is in alignment with a different one of the pockets of a different one of the chains of the second conveyor means moving in the flight thereof facing toward the first conveyor means.

14. The apparatus of claim 13, wherein the grooving means comprises:

a first grooving roller located between the ends of the flights of the chains of the first endless conveyor means facing the flights of the chains of the second endless conveyor means and further being located in the space between the pair of endless chain conveyors of the first endless conveyor means, the first grooving roller having a plurality of groove forming projections spaced apart about the periphery of the first roller; and, a second grooving roller located between the ends of the flights of the chains of the second endless conveyor means facing the flights of the chains of the first endless conveyor means and further being located in the space between the pair of endless chain conveyors of the second endless conveyor means, the second grooving roller having a plurality of groove forming projections spaced apart about the periphery of the second roller.

15. The apparatus of claim 14, wherein:

the gap between adjacent groove forming projections of the first grooving roller is less than the diameter of a filter rod; and, the gap between adjacent groove forming projections of the second grooving roller is less than the diameter of a filter rod.

16. The apparatus of claim 15 wherein:

the first and second grooving rollers are in substantial alignment with each other across the space between the facing conveyor flights of the first and second endless conveyor means such that the filter rods to be grooved moving with facing conveyor flights of the first and second endless conveyor means pass through the bite between the first and second grooving rollers whereupon two adjacent groove forming projections of each grooving roller embed into the filter rod.

* * * * *